US011464309B2

(12) United States Patent
McKelvey

(10) Patent No.: US 11,464,309 B2
(45) **Date of Patent: *Oct. 11, 2022**

(54) LUGGAGE WARDROBE SYSTEM AND METHOD OF USE

(71) Applicant: Sanni McKelvey, Lee's Summit, MO (US)

(72) Inventor: Sanni McKelvey, Lee's Summit, MO (US)

( * ) Notice: Subject to any disclaimer, the term of this patent is extended or adjusted under 35 U.S.C. 154(b) by 412 days.

This patent is subject to a terminal disclaimer.

(21) Appl. No.: 16/683,650

(22) Filed: Nov. 14, 2019

(65) Prior Publication Data

US 2020/0077761 A1 Mar. 12, 2020

Related U.S. Application Data

(63) Continuation-in-part of application No. 15/946,138, filed on Apr. 5, 2018, now Pat. No. 10,512,318.

(60) Provisional application No. 62/481,746, filed on Apr. 5, 2017.

(51) Int. Cl.

| | |
|---|---|
| ***A45C 13/28*** | (2006.01) |
| ***A47G 25/14*** | (2006.01) |
| *A47G 25/40* | (2006.01) |

(52) U.S. Cl.

CPC ..... *A45C 13/28* (2013.01); *A47G 25/1442* (2013.01); *A47G 25/40* (2013.01)

(58) Field of Classification Search

CPC ..... A45C 2013/267; A45C 13/28; A47G 25/1442; A47G 25/40

USPC ..... 190/18 R, 102

See application file for complete search history.

(56) References Cited

U.S. PATENT DOCUMENTS

| | | | | |
|---|---|---|---|---|
| 139,420 | A | 5/1873 | Payne | |
| 915,507 | A | 3/1909 | Thomas | |
| 930,343 | A | 8/1909 | Bonsall | |
| 2,639,793 | A | 5/1953 | Hellman | |
| 3,144,946 | A | 8/1964 | Ellis | |
| 4,245,763 | A | 1/1981 | Weinberg | |
| 4,267,905 | A | 5/1981 | Stewart | |
| 4,772,133 | A | 9/1988 | Volk | |
| 4,982,820 | A | 1/1991 | Scott | |
| 5,292,565 | A | 3/1994 | Napier et al. | |
| 5,306,063 | A | 4/1994 | Higgins et al. | |
| 5,379,870 | A | 1/1995 | Sadow | |
| 5,582,334 | A | 12/1996 | Blazer et al. | |
| 5,706,921 | A * | 1/1998 | Wang | A45C 13/262 190/115 |

(Continued)

FOREIGN PATENT DOCUMENTS

| | | |
|---|---|---|
| CA | 2081301 | 4/1994 |
| WO | 2007019379 | 2/2007 |

*Primary Examiner* — Sue A Weaver

(74) *Attorney, Agent, or Firm* — Law Office of Mark Brown, LLC; Christopher M. DeBacker

(57) ABSTRACT

A luggage system having a removable decorative storage crown for receiving and temporarily storing clothing items, such as suit jackets, uniforms, costumes, or other items using the same device that is used as a pull-handle. A stand element can be unfolded from the base of the luggage to act as a support, preventing the device from tipping when in a clothing rack orientation, but which can simply fold away when the luggage is being transported. A telescoping rod terminating in a cap may extend from the decorative storage crown for hanging hangers from the rod.

19 Claims, 10 Drawing Sheets

(56) References Cited

U.S. PATENT DOCUMENTS

| | | | | |
|---|---|---|---|---|
| 5,876,009 | A | 3/1999 | Simoncioni et al. | |
| 6,053,378 | A | 4/2000 | Doyel | |
| 6,119,835 | A | 9/2000 | Lin | |
| 6,129,254 | A | 10/2000 | Yu | |
| 6,264,047 | B1 | 7/2001 | Crumley | |
| 6,338,180 | B1 | 1/2002 | Massard | |
| 6,481,574 | B1 | 11/2002 | Pakosh | |
| 7,143,902 | B2 | 12/2006 | Iverson et al. | |
| 7,232,169 | B2 * | 6/2007 | Porter | A45F 5/1026 294/171 |
| 7,607,535 | B2 | 10/2009 | Jackson | |
| 8,490,764 | B2 | 7/2013 | Simester | |
| 8,714,369 | B2 | 5/2014 | Liu et al. | |
| 9,101,187 | B2 | 8/2015 | Zheng | |
| 9,622,597 | B2 | 4/2017 | White | |
| 10,016,034 | B2 * | 7/2018 | Lee | A45C 13/28 |
| 10,512,318 | B2 * | 12/2019 | McKelvey | A45C 9/00 |
| 2006/0249550 | A1 | 11/2006 | Giampavolo | |
| 2007/0089952 | A1 | 4/2007 | Herbst et al. | |
| 2007/0256994 | A1 | 11/2007 | Jackson | |
| 2007/0295570 | A1 | 12/2007 | Campbell et al. | |
| 2009/0000894 | A1 | 1/2009 | Middup | |
| 2009/0321204 | A1 | 12/2009 | Barkow | |
| 2011/0120826 | A1 | 5/2011 | Middup | |
| 2014/0027227 | A1 * | 1/2014 | Stern | A45C 13/262 190/115 |
| 2014/0326562 | A1 * | 11/2014 | Pickens | A45C 13/262 190/18 A |
| 2015/0173475 | A1 * | 6/2015 | Dermody | A45C 13/262 206/279 |
| 2016/0022032 | A1 | 1/2016 | Simon | |
| 2017/0071302 | A1 | 3/2017 | Mckelvey | |
| 2017/0071382 | A1 * | 3/2017 | Dehghan Dehnavi | B67D 3/0032 |

* cited by examiner

LUGGAGE WARDROBE SYSTEM AND METHOD OF USE

CROSS-REFERENCE TO RELATED APPLICATION

This application is a continuation-in-part of and claims priority in U.S. patent application Ser. No. 15/946,138 filed Apr. 5, 2018, now U.S. Pat. No. 10,512,318, issued Dec. 24, 2019 which claims priority in U.S. Provisional Patent Application No. 62/481,746 filed Apr. 5, 2017, all of which are incorporated herein by reference.

BACKGROUND OF THE INVENTION

1. Field of the Invention

The present invention relates generally to a hanging rack and luggage system and method for use thereof, and more specifically to a luggage system with a removable decorative storage crown and support stand.

2. Description of the Related Art

Dancers, performers, travelers, or anyone else often need to quickly change clothing or costumes in public places. Typical luggage requires the user to sift through piles of clothing to find the correct article. Existing luggage with wardrobe attachments require a wardrobe bar to extend from the storage compartment of the luggage, rendering the luggage unable to close while the wardrobe feature is in use. Further, these wardrobe features are typically made to be as lightweight and cheaply as possible, typically having a single structural post extending away from the luggage on either side of the crossbar and lack any kind of structural support.

Heretofore there has not been available a luggage wardrobe system or method of use with the advantages and features of the present invention.

BRIEF SUMMARY OF THE INVENTION

The present invention generally provides a luggage system including a removable decorative storage crown for receiving and temporarily storing clothing items, such as suit jackets, uniforms, costumes, or other items using the same device that is used as a pull-handle. A stand element can be unfolded from the base of the luggage to act as a support, preventing the device from tipping when in a clothing rack orientation, but which can simply fold away when the luggage is being transported.

BRIEF DESCRIPTION OF THE DRAWINGS

The drawings constitute a part of this specification and include exemplary embodiments of the present invention illustrating various objects and features thereof.

DETAILED DESCRIPTION OF THE PREFERRED EMBODIMENTS

I. Introduction and Environment

Figure 1:
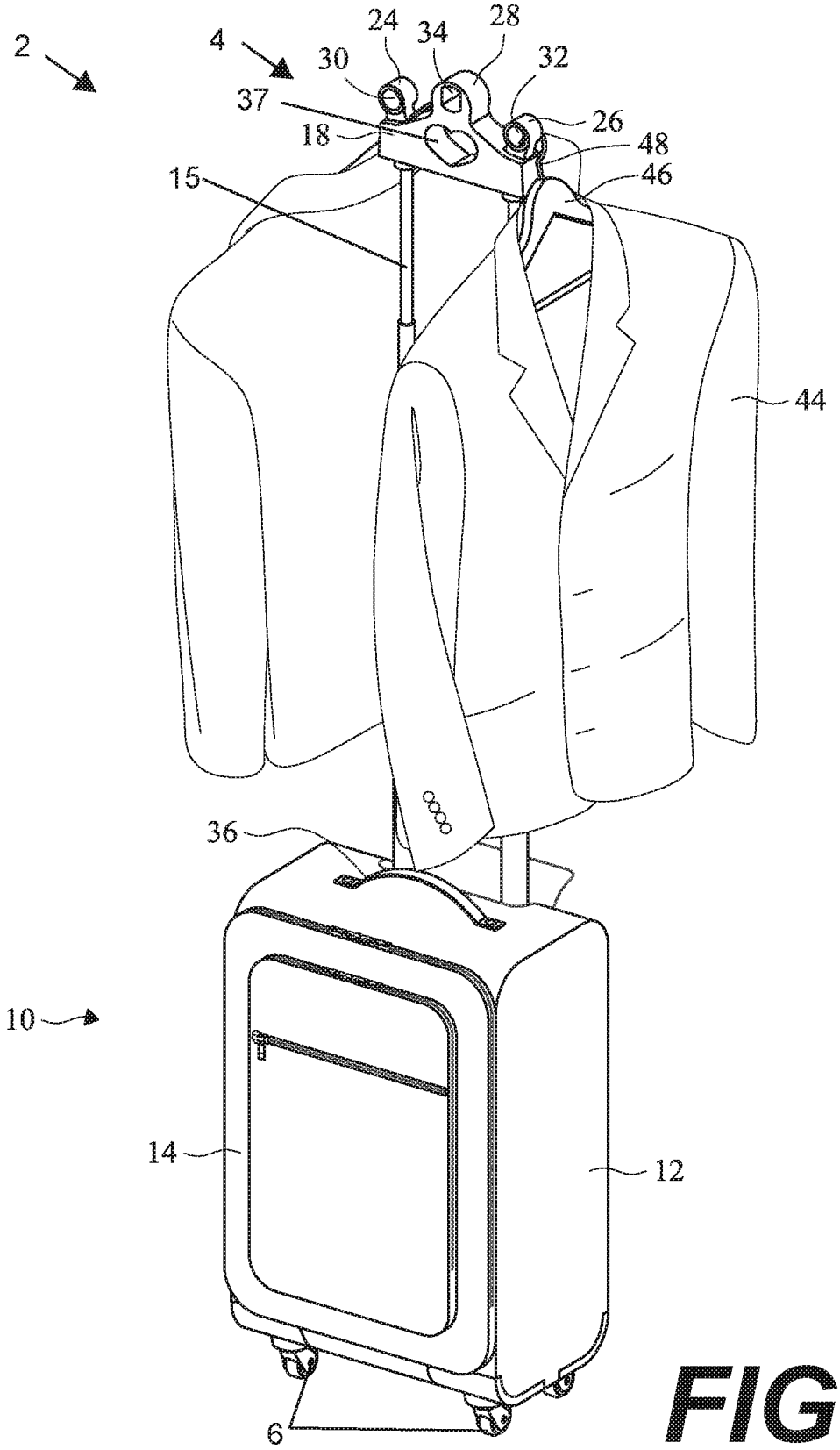
FIG. 1 is a three-dimensional isometric frontal view of a preferred embodiment of the present invention in a wardrobe storage orientation.

As required, detailed aspects of the present invention are disclosed herein, however, it is to be understood that the disclosed aspects are merely exemplary of the invention, which may be embodied in various forms. Therefore, specific structural and functional details disclosed herein are not to be interpreted as limiting, but merely as a basis for the claims and as a representative basis for teaching one skilled in the art how to variously employ the present invention in virtually any appropriately detailed structure.

Certain terminology will be used in the following description for convenience in reference only and will not be limiting. For example, up, down, front, back, right and left refer to the invention as orientated in the view being referred to. The words, "inwardly" and "outwardly" refer to directions toward and away from, respectively, the geometric center of the aspect being described and designated parts thereof. Forwardly and rearwardly are generally in reference to the direction of travel, if appropriate. Said terminology will include the words specifically mentioned, derivatives thereof and words of similar meaning.

II. Preferred Embodiment Luggage Wardrobe System 2

The present invention provides a piece of luggage 10 which includes at least one handle 20 and a telescoping tow bar 15 for towing the luggage along the ground using caster wheels. The luggage may have a second handle 36 for when the first handle 20 and tow bar 15 are stored. The luggage 10 also contains zippable compartments 14 and structural sidewalls 12 as is common in such luggage. A preferred embodiment of luggage 10 includes four wheels 6 or casters, but could be constructed with only two wheels. As is typical with these types of luggage, the tow bar allows the user to easily tow the luggage 10 behind them using the tow bar and casters.

Figure 2:
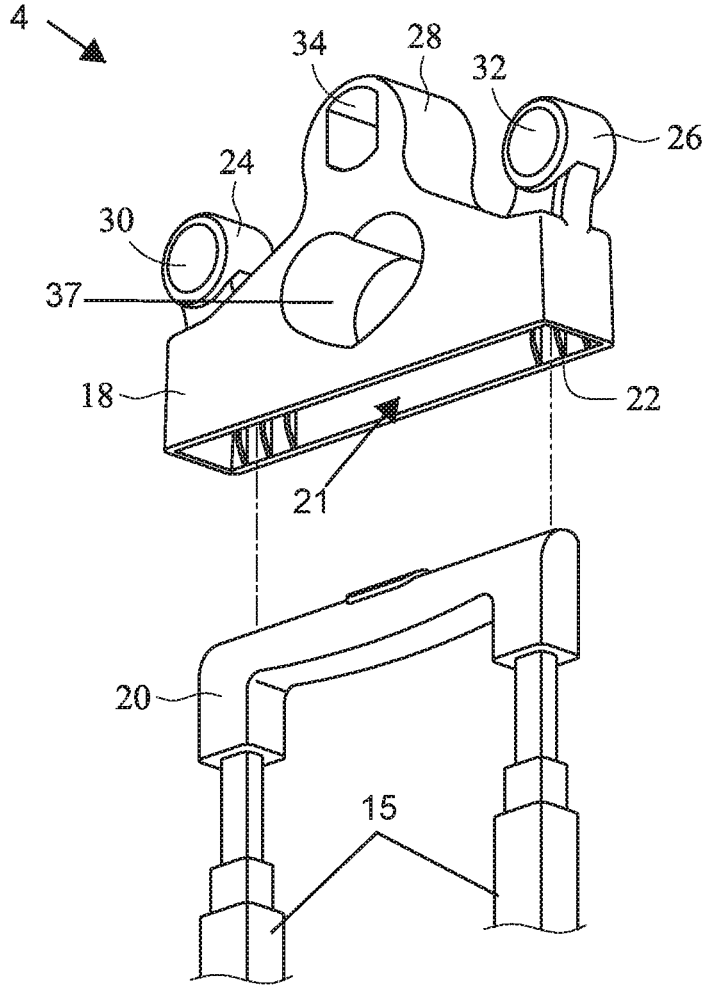
FIG. 2 is a detailed exploded isometric view showing a decorative storage crown element being connected to the end of a pull handle element.
Figure 3:
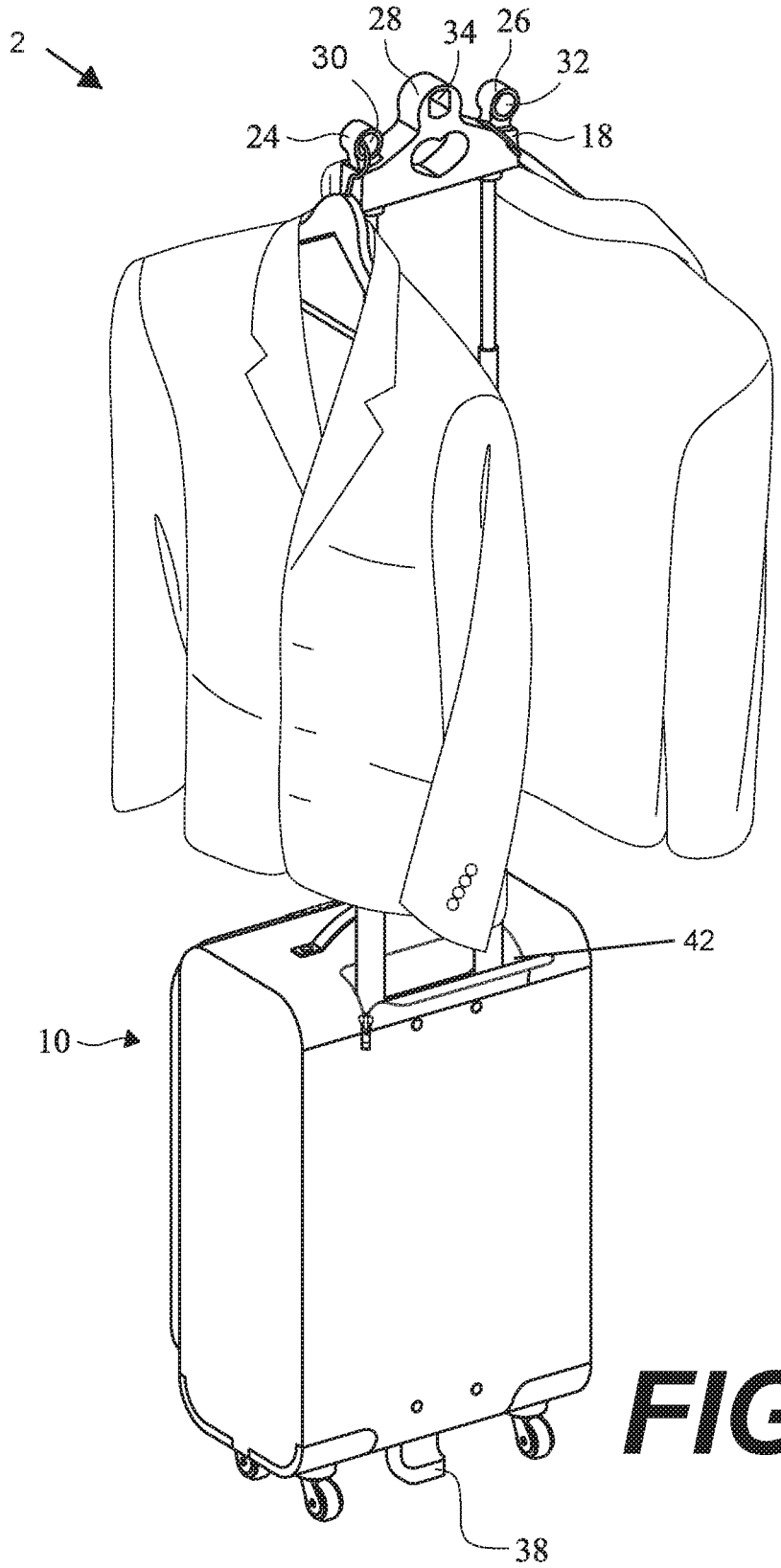
FIG. 3 is another three-dimensional isometric view of the embodiment of FIG. 1 from a rear angle.
Figure 4:
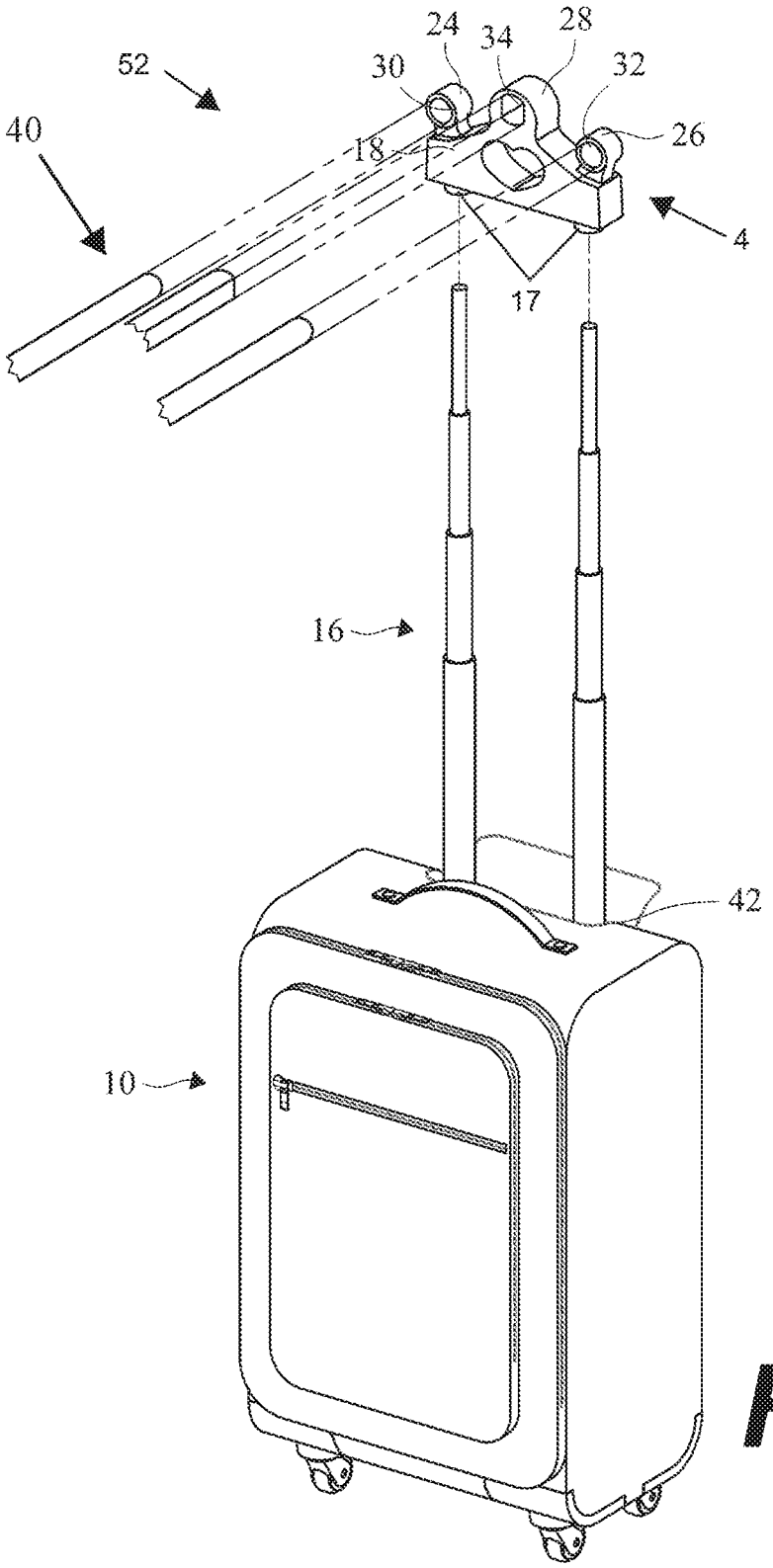
FIG. 4 is a three-dimensional isometric view of a slightly alternative embodiment thereof.
Figure 5:
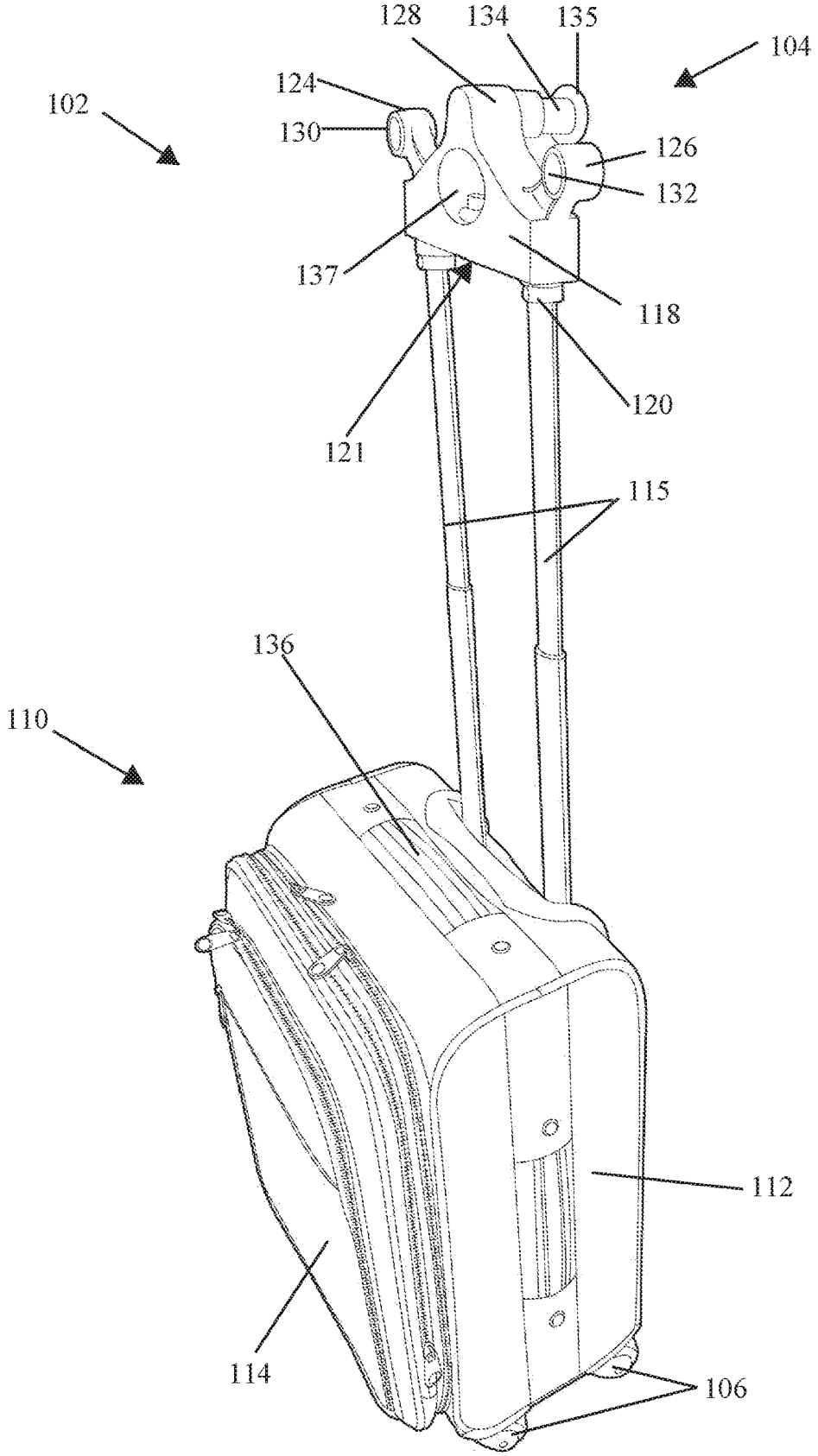
FIG. 5 is a three-dimensional right-side view of an alternative embodiment of the present invention.

The luggage 10 can be transformed into an upright wardrobe storage system by flipping out a structural stand 38 on the base of the luggage 10, as shown in FIG. 2, thereby preventing the luggage element from tipping over. The tow bar 15 is extended to its full height and a removable decorative storage crown 4 is placed upon the handle 20. The semi-universal storage crown 4 body 18 fits over the top handle 20 of the tow bar 15 and includes a pair of hanger receiver elements 24, 26 on either side of the crown, along with a decorative central opening 28 which can accommodate more hangers 46 holding garments 44. The hanger 46 hooks 48 loop into the openings 30, 32 of the receivers 24, 26, or may hook around the outside of the receivers. Two such luggage wardrobe systems placed in proximity could support a wardrobe bar 40 between the two by slotting the bar into one of the openings 30, 32, 34 in the crown's receiver elements as shown in FIG. 4, allowing for much more clothing capacity. The center opening 34 may be differently shaped, as shown in FIG. 2, which includes a curved top edge, curved bottom edge, and straight side edges.

The storage crown 4, as stated above, is somewhat universal and should fit on the top of most standard luggage tow handles 20. A recess 21 in the base of the crown receives the top-most handle portion of the tow handle and provides several places for receiving clothing hangers and other hanging implements for temporary storage. FIG. 2 shows how this interaction occurs in more detail. Fins 22 within the crown 4 provide a snug fit over the handle 20 portion of the tow handle. The two side receivers 24, 26 can receive clothing hangers, and each may include openings 30, 32 for receiving hangers or for potentially placing a rod between two such crowns 4 for a larger area for hanging clothing and other items as described above. A top knob 28 includes a similar opening 34. A heart-shaped opening 37 could also be used to place hangers or items or for a bar to be placed between two such systems placed in proximity.

The tow bars 15 and handle 20 can be stored away within the luggage into a zipped compartment 42.

FIG. 4 shows a slightly alternative luggage system 52 embodiment. The only difference here is that the luggage 10 has a pair of telescoping tow bars 16 and the crown 4 is placed directly onto the tow bars, replacing the handle element of the previous embodiment. A pair of receivers 17 may be necessary to adapt the crown 4 to such an arrangement.

III. Alternative Embodiment Luggage Wardrobe System 102

As shown in FIGS. 5-9, a piece of luggage 110 which includes at least one handle 120 at the end of a telescoping tow bar 115 for towing the luggage along the ground using caster wheels 106. A recess 142 receives the handle when not in use. The luggage may have a second handle 136 for when the first handle and tow bar 115 are stored. The luggage 110 also contains zippable compartments 114 and structural sidewalls 112 as is common in such luggage. A preferred embodiment of luggage 110 includes four wheels 106 or casters, but could be constructed with only two wheels. As is typical with these types of luggage, the tow bar allows the user to easily tow the luggage 110 behind them using the tow bar and casters.

Figure 6:
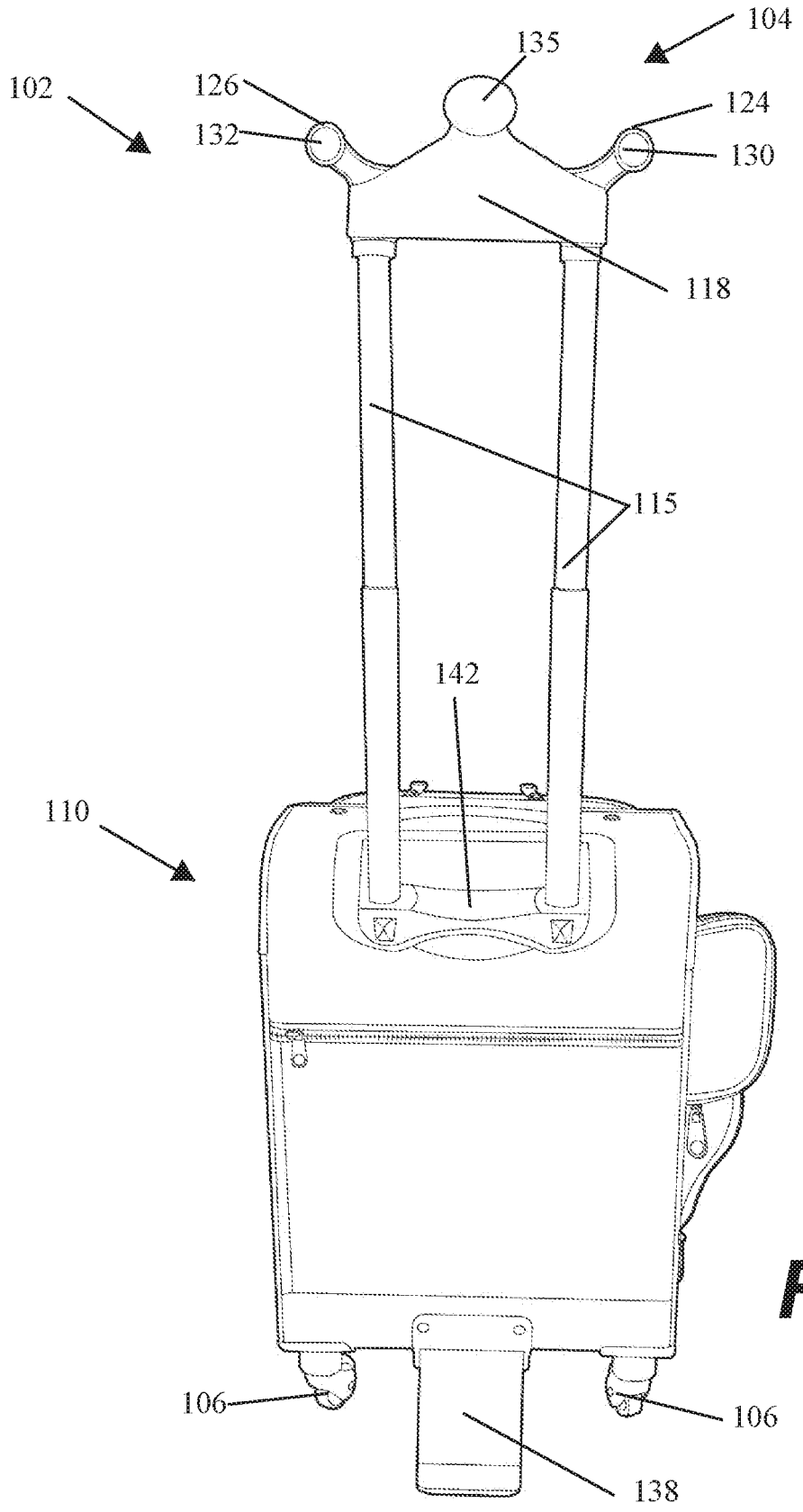
FIG. 6 is a three-dimensional front-down view thereof.
Figure 7:
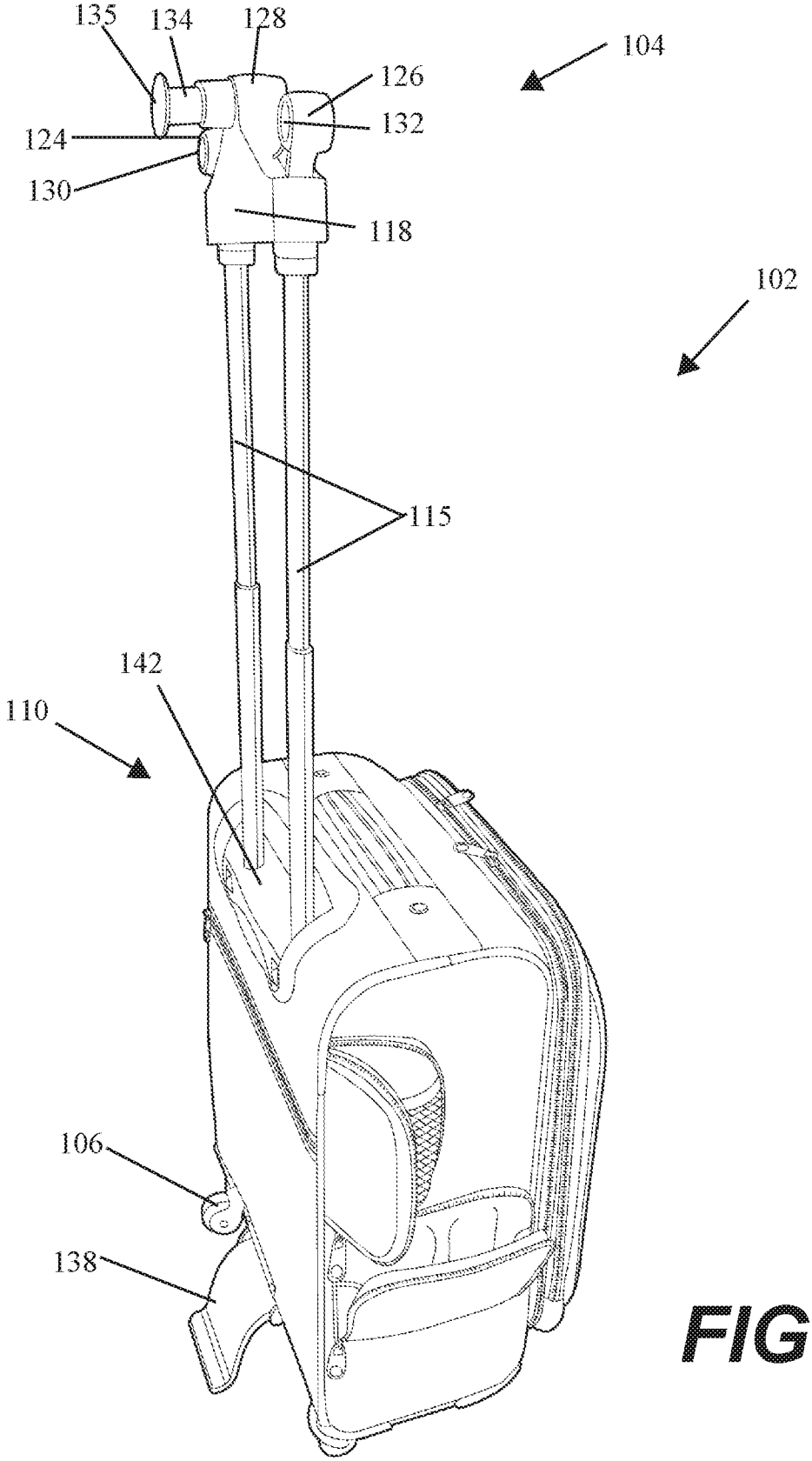
FIG. 7 is a three-dimensional rear left view thereof.
Figure 8:
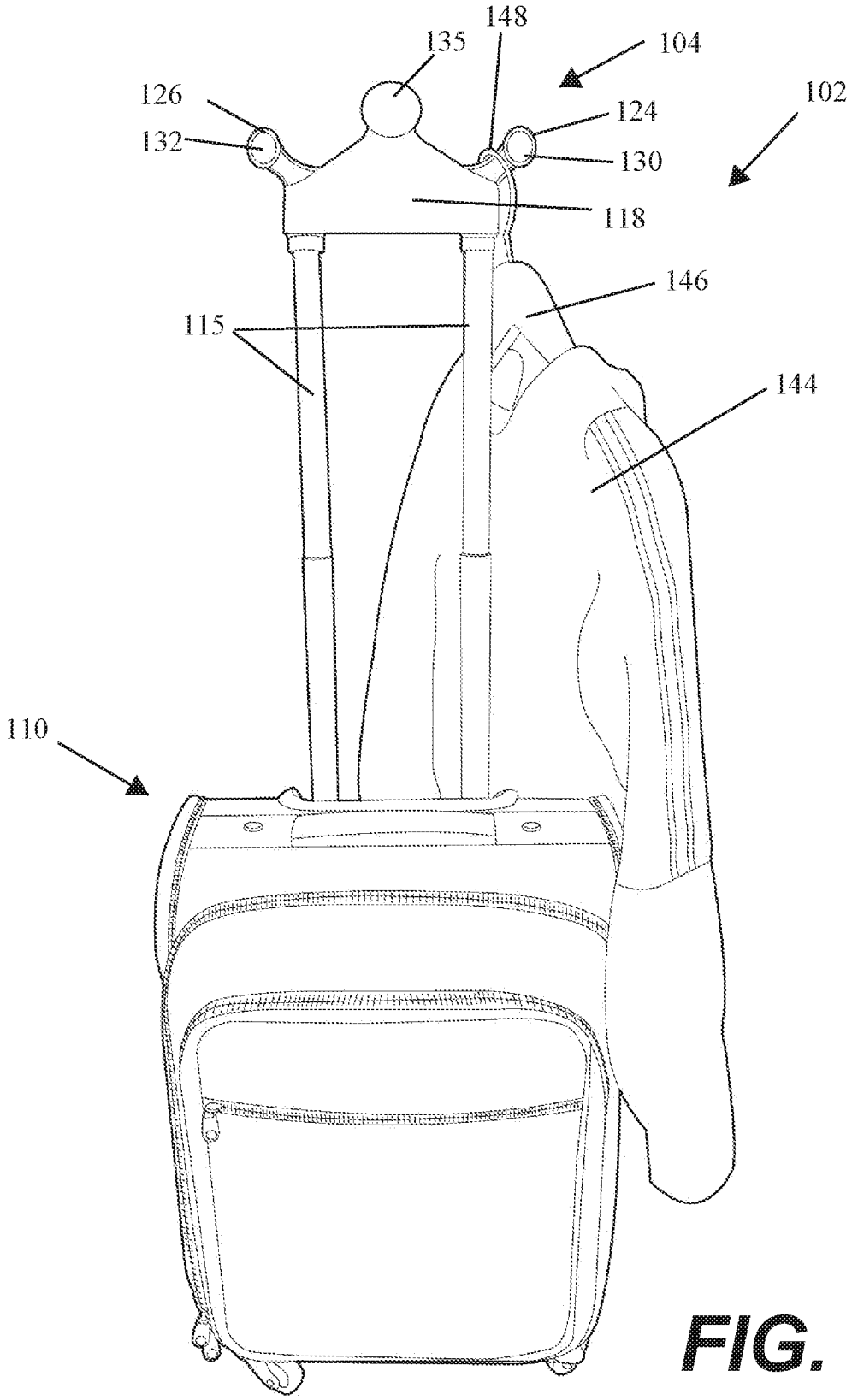
FIG. 8 is a three-dimensional front-down view thereof showing a clothing item of a typical environment engaging with the embodiment thereof.
Figure 9:
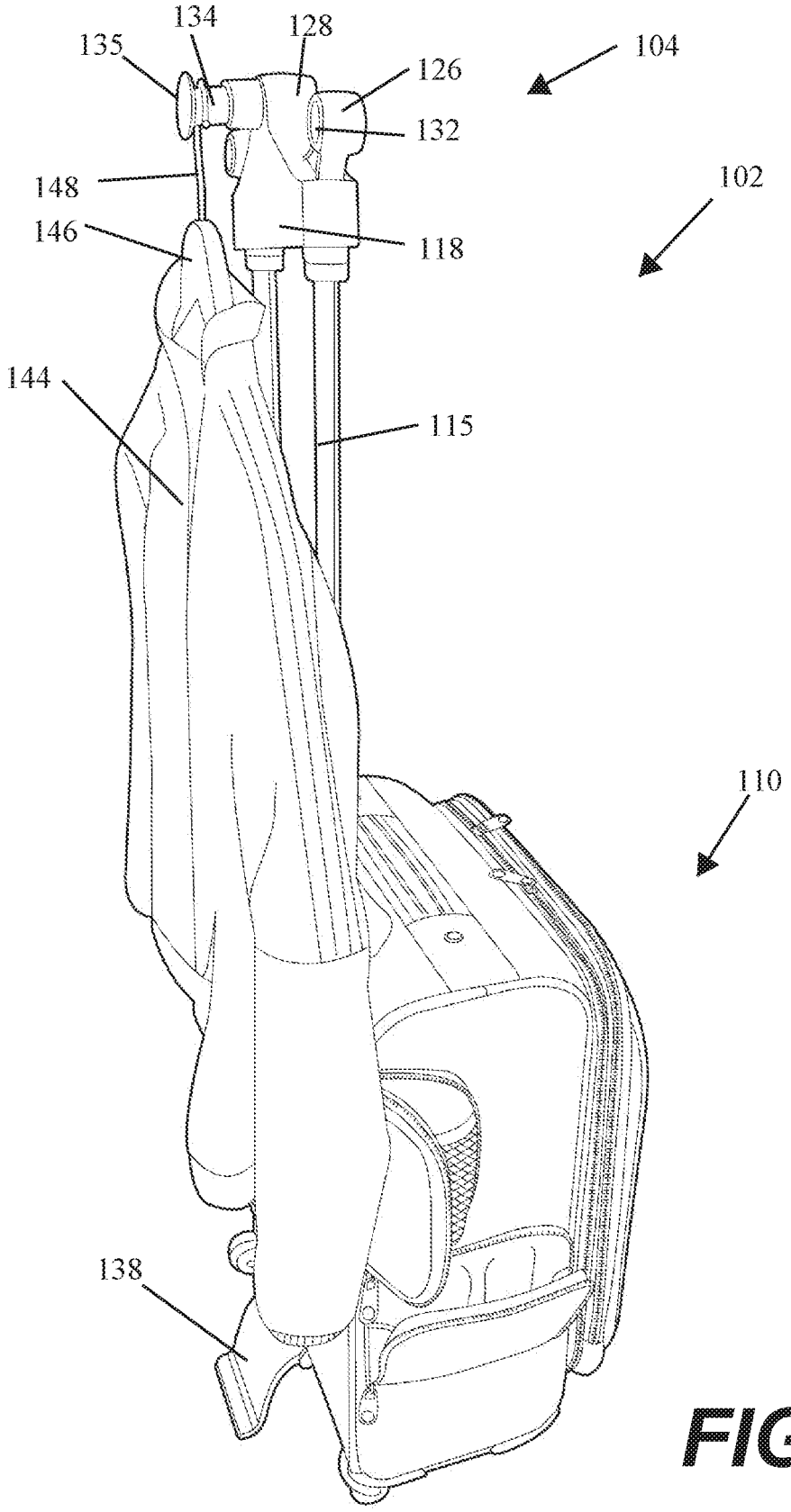
FIG. 9 is a three-dimensional rear left view thereof.

The luggage 110 can be transformed into an upright wardrobe storage system by flipping out a structural stand 138 on the base of the luggage 110, as shown in FIG. 6, thereby preventing the luggage element from tipping over. The tow bar 115 is extended to its full height and a removable decorative storage crown 104 is placed upon the handle. The semi-universal storage crown 104 body 118 fits over the top handle 120 of the tow bar 115 which is slotted into a receiver 121 of the storage crown 104, and the storage crown 104 includes a pair of hanger receiver elements 124, 126 on either side of the crown, along with a decorative central opening 128 which can accommodate more hangers 146 holding garments 144. The hanger 146 hooks 148 loop into the openings 130, 132 of the receivers 124, 126, or may hook around the outside of the receivers. Two such luggage wardrobe systems placed in proximity could support a wardrobe bar (not shown) between the two by slotting the bar into one of the openings 130, 132, 137 in the crown's receiver elements, allowing for much more clothing capacity. Alternatively, a telescoping rod 134 with a cap 135 extends out from the crown 104 which can receive the hook 148 of a hanger 146 to store a garment 144. This could simply be manually slid in or out of the crown, or could have a spring release which when pressed pops the rod 134 out of the crown 104, and which will lock the rod 134 back into the crown 104 when not in use.

Figure 10:
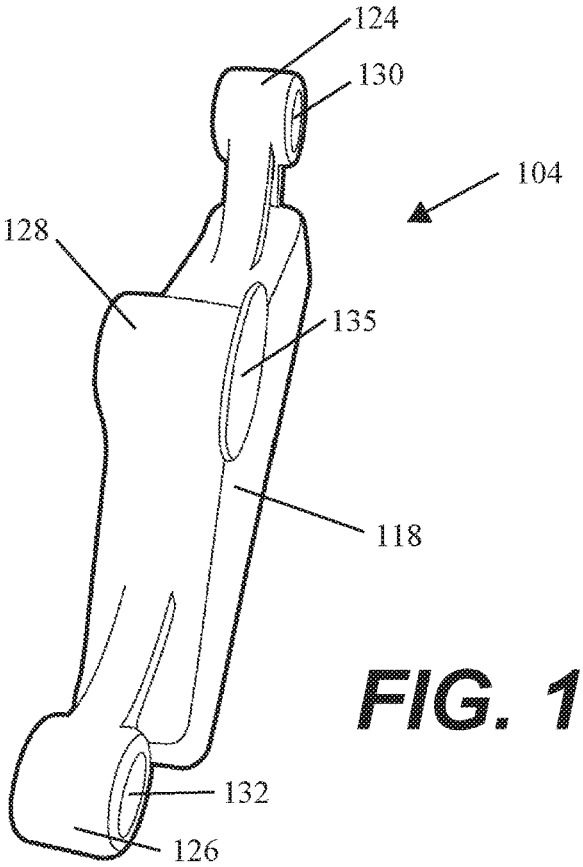
FIG. 10 is a three-dimensional top-down view of a crow element thereof with a rod element in a retracted position.
Figure 11:
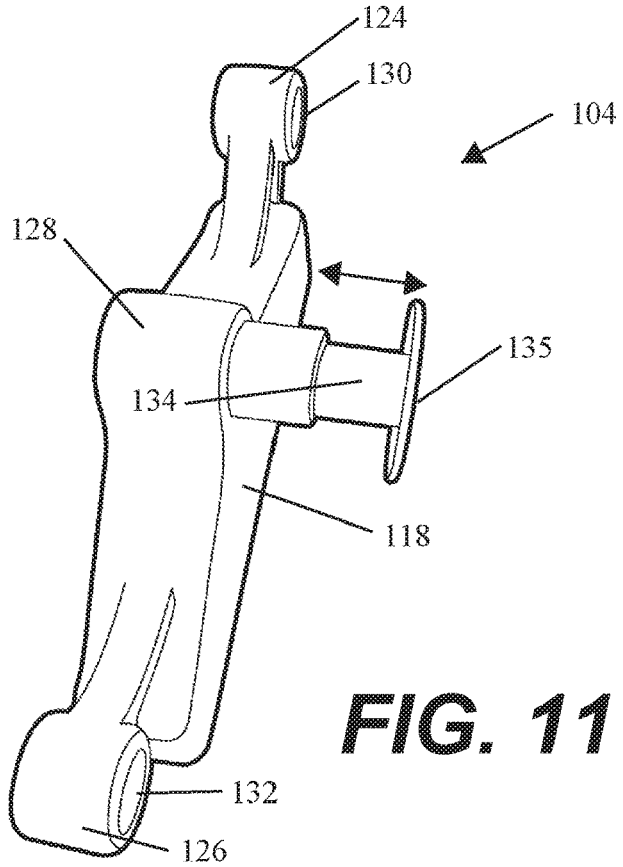
FIG. 11 is a three-dimensional top-down view thereof with the rod element shown in an extended position.

FIGS. 10 and 11 show the crown 104 in more detail, including the telescoping rod 134 and cap 135. The cap 135 prevents the hanger hook 148 from falling off of the edge of the rod 134.

It is to be understood that while certain embodiments and/or aspects of the invention have been shown and described, the invention is not limited thereto and encompasses various other embodiments and aspects.

Having thus described the invention, what is claimed as new and desired to be secured by Letters Patent is:

1. A decorative crown for a luggage system, the decorative crown comprising:

a rectangular base having a hollow bottom face configured for receiving a handle of a piece of luggage;

a first and second receiver located on opposite ends of a top face of said rectangular base, each configured for receiving hanger hooks;

a third receiver located in between said first and second receivers, said third receiver configured for receiving hanger hooks;

an extendable rod terminating in a cap configured to be repositioned from a first, stored position within said rectangular base with said cap flush against said rectangular base, and a second, extended position with a telescoping rod extending away from said rectangular base, said telescoping rod configured to receive a hanger hook.

2. The decorative crown of claim 1, further comprising:

each of said first and second receivers comprising a circular shape;

each of said first and second receivers having a circular hole passing through them; and each said circular hole configured for receiving hanger hooks.

3. The decorative crown of claim 2, wherein each said circular hole further configured for receiving an end of a wardrobe bar.

4. The decorative crown of claim 1, further comprising:

said third receiver comprising a generally circular shape;

said third receiver having a hole passing through it; and said hole configured for receiving hanger hooks.

5. The decorative crown of claim 4, wherein each said circular hole further configured for receiving an end of a wardrobe bar.

6. The decorative crown of claim 4, wherein said hole has a curved top edge, a curve bottom edge, and two straight side edges.

7. The decorative crown of claim 1, further comprising a hole located within and passing through said rectangular base.

8. The decorative crown of claim 7, wherein said hole is heart shaped.

9. The decorative crown of claim 1, further comprising:

said hollow bottom face of said rectangular base further comprising a plurality of fins located on internal walls of said rectangular base; and said fins configured for gripping against said handle, thereby securing said rectangular base to said handle.

10. The decorative crown of claim 1, further comprising:

wherein said luggage comprises a stand configured for being moved between a first, stored position within said luggage and a second, extended position;

said handle connected to a pair of telescoping rods; and said stand configured for balancing said luggage when said handle is extended upon said telescoping rods, said decorative crown is placed atop said handle, and a garment is hung from at least one of said first, second, and third receivers.

11. A decorative crown for a luggage system, the decorative crown comprising:

a rectangular base having a hollow bottom face configured for receiving a handle of a piece of luggage;

a first and second receiver located on opposite ends of a top face of said rectangular base, each configured for receiving hanger hooks;

each of said first, and second receivers having a respective hole passing through them;

each said hole configured for receiving hanger hooks;

an extendable rod terminating in a cap configured to be repositioned from a first, stored position within said rectangular base with said cap flush against said rectangular base, and a second, extended position with a telescoping rod extending away from said rectangular base, said telescoping rod configured to receive a hanger hook;

said hollow bottom face of said rectangular base further comprising a plurality of fins located on internal walls of said rectangular base; and said fins configured for gripping against said handle, thereby securing said rectangular base to said handle.

12. A luggage system comprising:

a piece of luggage having a handle connected to a pair of telescoping rods, said handle configured for being telescoped from a first, stored position within said luggage to a second, extended position vertically extended above said luggage;

a stand configured for being moved between a first, stored position within said luggage and a second, extended position, said stand configured for balancing said luggage when said handle is extended to said second, extended position;

a decorative crown configured for being removably placed upon said handle when said handle is in said second, extended position;

said decorative crown comprising a rectangular base having a hollow bottom face configured for receiving said handle;

said decorative crown comprising a first and second receiver located on opposite ends of a top face of said rectangular base, each configured for receiving hanger hooks;

said decorative crown comprising a third receiver located in between said first and second receivers, said third receiver configured for receiving hanger hooks; and said decorative crown further comprising an extendable rod terminating in a cap configured to be repositioned from a first, stored position within said rectangular base with said cap flush against said rectangular base, and a second, extended position with a telescoping rod extending away from said rectangular base, said telescoping rod configured to receive a hanger hook.

13. The luggage system of claim 12, further comprising:

each of said first and second receivers comprising a circular shape;

each of said first and second receivers having a circular hole passing through them; and each said circular hole configured for receiving hanger hooks.

14. The luggage system of claim 13, wherein each said circular hole further configured for receiving an end of a wardrobe bar.

15. The luggage system of claim 12, further comprising:

said third receiver comprising a generally circular shape;

said third receiver having a hole passing through it; and said hole configured for receiving hanger hooks.

16. The luggage system of claim 15, wherein each said circular hole further configured for receiving an end of a wardrobe bar.

17. The luggage system of claim 15, wherein said hole has a curved top edge, a curve bottom edge, and two straight side edges.

18. The luggage system of claim 12, further comprising a hole located within and passing through said rectangular base.

19. The luggage system of claim 12, wherein said hole is heart shaped.

* * * * *